US009780440B2

(12) United States Patent
Onaka et al.

(10) Patent No.: US 9,780,440 B2
(45) Date of Patent: Oct. 3, 2017

(54) ANTENNA DEVICE AND ELECTRONIC APPARATUS

(71) Applicant: MURATA MANUFACTURING CO., LTD., Nagaokakyo-Shi, Kyoto-fu (JP)

(72) Inventors: Kengo Onaka, Nagaokakyo (JP); Hiroya Tanaka, Nagaokakyo (JP)

(73) Assignee: MURATA MANUFACTURING CO., LTD., Nagaokakyo-Shi, Kyoto-Fu (JP)

( * ) Notice: Subject to any disclaimer, the term of this patent is extended or adjusted under 35 U.S.C. 154(b) by 545 days.

(21) Appl. No.: 14/471,728

(22) Filed: Aug. 28, 2014

(65) Prior Publication Data

US 2014/0368391 A1 Dec. 18, 2014

Related U.S. Application Data

(63) Continuation of application No. PCT/JP2013/053309, filed on Feb. 13, 2013.

(30) Foreign Application Priority Data

Mar. 5, 2012 (JP) ..... 2012-047549

(51) Int. Cl.
*H01Q 1/27* (2006.01)
*H01Q 1/50* (2006.01)
(Continued)

(52) U.S. Cl.
CPC ..... *H01Q 1/273* (2013.01); *H01Q 1/50* (2013.01); *H01Q 7/00* (2013.01); *H01Q 1/48* (2013.01)

(58) Field of Classification Search
None
See application file for complete search history.

(56) References Cited

U.S. PATENT DOCUMENTS 4,803,491 A * 2/1989 Hikuma ..... H01Q 1/24 343/702
6,611,504 B1 8/2003 Kanda et al.
(Continued)

FOREIGN PATENT DOCUMENTS

JP 2000-114865 A 4/2000
JP 2004-518322 A 6/2004
(Continued)

OTHER PUBLICATIONS

Written Opinion and International Search Report issued in PCT/JP2013/053309 dated May 14, 2013.

*Primary Examiner* — Howard Williams
(74) *Attorney, Agent, or Firm* — Arent Fox LLP

(57) ABSTRACT

An antenna device includes a communication module and a loop-shaped conductor. The communication module has a substrate on which an approximately rectangular ground conductor is formed. A non-ground region is provided along one side of the ground conductor. A transmission line and a radiation element are formed in the non-ground region. Further, a capacitance element is connected to the radiation element, and the transmission line is connected to a feeding point of the radiation element. The loop-shaped conductor includes in part a gap that is positioned near the radiation element. With this, an antenna device to be provided in an electronic apparatus having wide directivity in a state of being attached to a garment, a person's body, or the like, and the stated electronic apparatus are configured.

20 Claims, 20 Drawing Sheets

(51) Int. Cl.
*H01Q 7/00* (2006.01)
*H01Q 1/48* (2006.01)

(56) References Cited

U.S. PATENT DOCUMENTS

| | | | | |
|---|---|---|---|---|
| 6,680,707 | B2 | 1/2004 | Allen et al. | |
| 7,265,720 | B1 * | 9/2007 | Ponce De Leon ..... | H01Q 1/243 343/700 MS |
| 7,427,960 | B2 | 9/2008 | Mizutani et al. | |

FOREIGN PATENT DOCUMENTS

| | | | |
|---|---|---|---|
| JP | 2008-017299 | A | 1/2008 |
| JP | 2008-060899 | A | 3/2008 |
| JP | 2010-130100 | A | 6/2010 |
| JP | 2011-228880 | A | 11/2011 |

* cited by examiner (A)

(B)

PRIOR ART

ANTENNA DEVICE AND ELECTRONIC APPARATUS

CROSS REFERENCE TO RELATED APPLICATIONS

The present application is a continuation of International Application No. PCT/JP2013/053309, filed Feb. 13, 2013, which claims priority to Japanese Patent Application No. 2012-047549, filed Mar. 5, 2012, the entire contents of each of which are incorporated herein by reference.

FIELD OF THE INVENTION

The present invention relates to mobile electronic apparatuses configured to perform wireless communications, in particular, electronic apparatuses capable of performing wireless communications in a state of being attached to a garment, a person's body, or the like, and antenna devices provided in the stated electronic apparatuses.

BACKGROUND OF THE INVENTION

An antenna device of an electronic apparatus capable of performing wireless communications in a state of being attached to a garment, a person's body, or the like is disclosed in Patent Document 1.

FIG. 23 is a diagram illustrating a usage state of the antenna device disclosed in Patent Document 1. An antenna 20 is a fabric patch antenna, and the stated antenna is set in an antenna mounting unit 30 to be accommodated between the shoulder blades at the back of a person. The antenna mounting unit 30 includes supporting straps that extend in use from a portion of the antenna mounting unit where the antenna is held, over the shoulders of the wearer, and down to the front of the wearer's torso.

Patent Document 1: Japanese Unexamined Patent Application Publication (Translation of PCT Application) No. 2004-518322.

As shown in FIG. 23, in the antenna device having a structure in which the patch antenna is mounted in the antenna mounting unit at the side of the wearer's back, only the radiation toward the side of the back is strong, whereas the radiation toward the front side (chest side) cannot be expected. In addition, because the antenna is a patch antenna, size of the element itself is likely to be large. This makes the antenna module likely to become large when the circuit side is integrated therein. Furthermore, thickness of the antenna in a thickness direction thereof becomes large, which can annoy the wearer of the antenna.

SUMMARY OF THE INVENTION

An object of the present invention is to provide antenna devices having wide directivity in a state of being attached to a garment, a person's body, or the like, and electronic apparatuses provided with the stated antenna devices.

An antenna device according to the present invention is configured as follows in order to solve the above problems.

The stated antenna device includes a ground conductor formed in an approximately rectangular shape, a non-ground region provided along one side of the ground conductor, and a radiation element formed in the non-ground region; and the antenna device further includes a loop-shaped conductor disposed at a position which is in the vicinity of the one side of the ground conductor where the non-ground region is formed and which does not overlap with the ground conductor.

It is preferable for the loop-shaped conductor to be formed in a neck strap that is worn around a user's neck.

It is preferable for the radiation element to be accommodated in a housing, and for the neck strap to be attached to the stated housing.

It is preferable for the loop-shaped conductor to have a gap that is formed at a position closest to the radiation element.

It is preferable for a length of the circumference of the loop-shaped conductor to be equal to or greater than half the wavelength of a frequency used by the antenna device.

An electronic apparatus according to the present invention includes a ground conductor formed in an approximately rectangular shape, a non-ground region provided along one side of the ground conductor, a radiation element formed in the non-ground region, and a loop-shaped conductor disposed at a position which is in the vicinity of the one side of the ground conductor where the non-ground region is formed and which does not overlap with the ground conductor; and the loop-shaped conductor is provided in a neck strap, and the ground conductor and the radiation element are provided in a housing.

According to the present invention, an antenna device having wide directivity in a state where an electronic apparatus is attached to a garment, a person's body, or the like, and the stated electronic apparatus are obtained.

BRIEF DESCRIPTION OF DRAWINGS

FIG. 5(A) illustrates directivity on an x-y plane (horizontal plane) when viewed from top of the head, while FIG. 5(B) illustrates directivity on a z-y plane (vertical plane) when viewed from the right side.

FIGS. 15(A) and 15(B) are diagrams illustrating directivity of the antenna device of the first embodiment (device including a loop-shaped conductor), while FIGS. 15(C) and 15(D) are diagrams illustrating directivity of an antenna device as a comparative example (device without a loop-shaped conductor).

FIG. 21(A) is a perspective view illustrating a housing of the communication module as a part of an antenna device, while FIG. 21(B) is a perspective view illustrating a rear-side section of the housing when the housing is separated into two sections.

DETAILED DESCRIPTION OF THE PREFERRED EMBODIMENTS

First Embodiment

Figure 1:
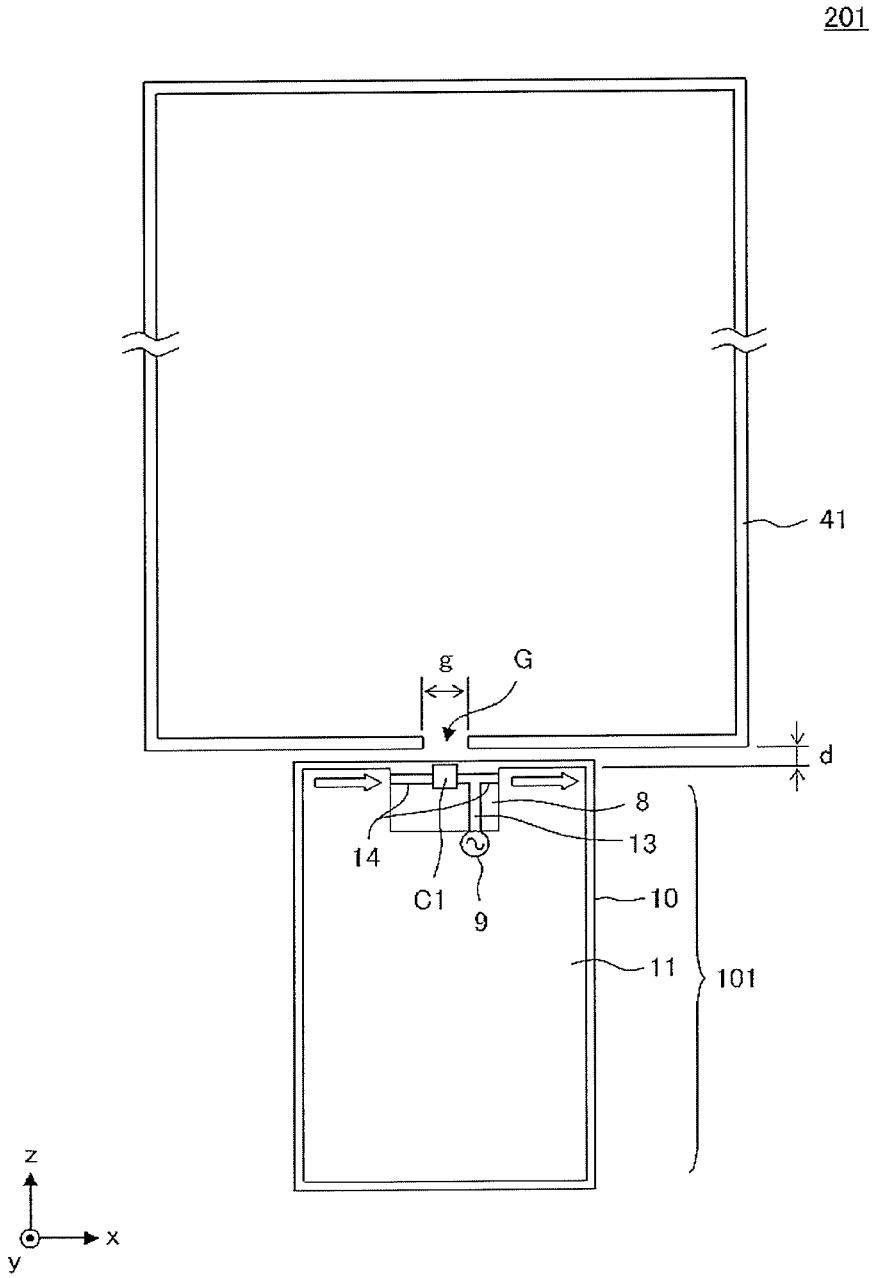
FIG. 1 is a diagram illustrating the principal constituent elements of an antenna device 201 according to a first embodiment.

FIG. 1 is a diagram illustrating the principal constituent elements of an antenna device 201 according to a first embodiment. In FIG. 1, the antenna device 201 includes a communication module 101 and a loop-shaped conductor 41. The communication module 101 has a substrate 10 on which an approximately rectangular ground conductor 11 is formed. A non-ground region 8 is provided along one side of the ground conductor 11. A transmission line 13 and a radiation element 14 are formed in the non-ground region 8. Further, a capacitance element C1 is connected to the radiation element 14, and the transmission line 13 is connected to a feeding point of the radiation element 14. A feeder circuit 9 is provided on the substrate 10 and power is fed to the radiation element 14 by the feeder circuit 9 via the transmission line 13.

Feeding the power to the radiation elements 14 causes the radiation element 14 to resonate. A current is induced in the ground conductor 11 in the same manner as in a case of dipole antenna (current is induced in a dipole antenna-like manner). Arrows in FIG. 1 indicate a flow of the induced current. Another ground conductor is also formed on the rear surface of the substrate 10 at a position opposing the ground conductor 11. The ground conductor on the rear surface has the same shape as the shape of the ground conductor 11 and is connected therewith by a via conductor. Accordingly, the same current flows in the ground conductor on the rear surface.

The loop-shaped conductor 41 has a gap G in a specified portion, and the gap G is positioned in the vicinity of the radiation element 14.

Figure 2:
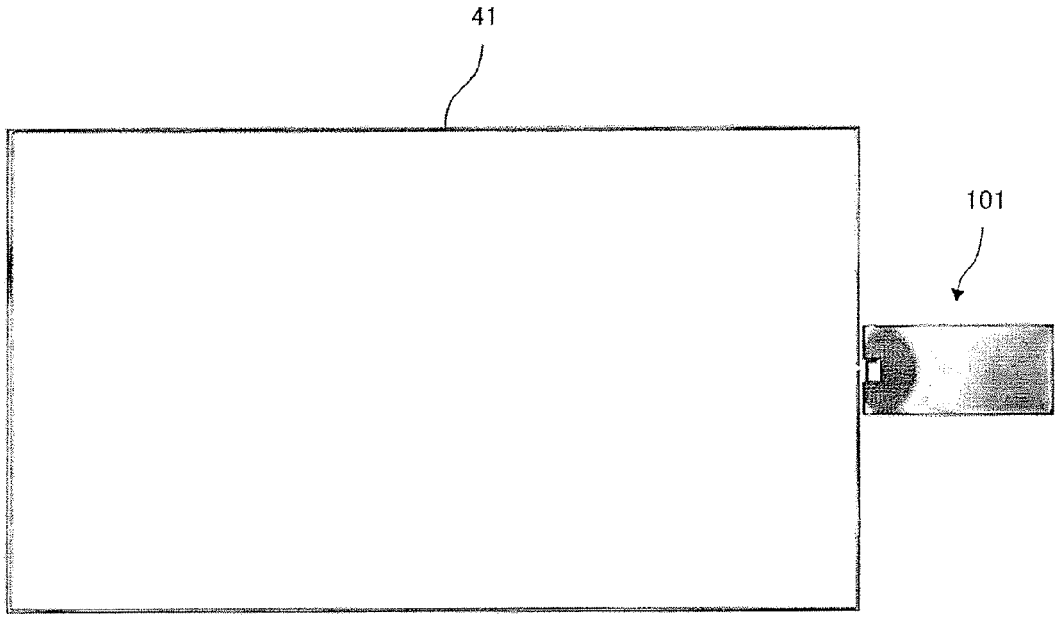
FIG. 2 is a diagram illustrating intensity of a current flowing in a ground conductor of a communication module 101 and a current flowing in a loop-shaped conductor 41 by shading.

FIG. 2 is a diagram illustrating intensity of a current flowing in the ground conductor of the communication module 101 and a current flowing in the loop-shaped conductor 41 by shading. As shown in the drawing, standing waves of several wavelengths of the current are formed in the loop-shaped conductor 41 via the communication module 101. The following are conditions for the device.

Frequency: 2450 MHz

Size of the communication module 101: 26 mm×56 mm×1.2 mm

Size of the loop-shaped conductor 41: 250 mm×150 mm×1 mm

Figure 3:
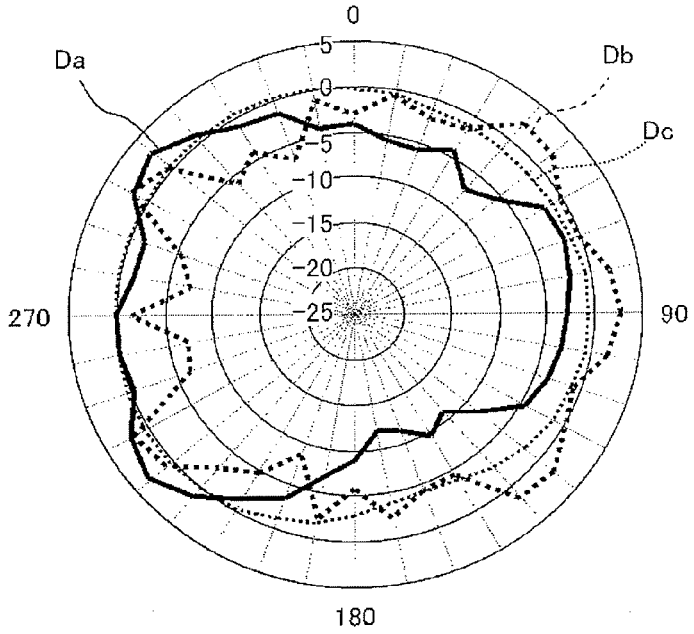
FIG. 3 is a diagram illustrating antenna directivity of the antenna device shown in FIG. 1 and comparative examples thereof.

Distance "d" between the communication module 101 and the loop-shaped conductor 41: 1 mm Dimension "g" of the gap G in the loop-shaped conductor 41: 2 mm FIG. 3 is a diagram illustrating antenna directivity of the antenna device shown in FIG. 1 and comparative examples thereof. Of two antenna devices as the comparative examples, a first antenna device is a device such that the antenna device shown in FIG. 1 does not have the gap in the loop-shaped conductor 41. A second antenna device is a device such that the antenna device shown in FIG. 1 does not have the loop-shaped conductor. In FIG. 3, a characteristic Da indicates the directivity of the antenna device of the present embodiment, a characteristic Db indicates the directivity of the first antenna device as the comparative example, and a characteristic Dc indicates the directivity of the second antenna device as the comparative example. The measurement unit is dBi in this case. The direction of 270 degrees is a direction along which the loop-shaped conductor 41 extends. In this manner, by providing the loop-shaped conductor 41 to be coupled to the radiation element 14 of the communication module 101, it is possible to change the directivity and raise a gain in the direction along which the loop-shaped conductor 41 extends.

In the case where the size of the loop-shaped conductor is set to 30 mm×370 mm×1 mm, that is, the shape thereof is elongated while the length of the circumference thereof being kept the same, antenna radiation efficiency is −1 dB, which is equivalent to the efficiency of the above-mentioned antenna device. In other words, by providing the loop-shaped conductor, an effect of changing directivity can be obtained even if the loop-shaped conductor is used being hung from a human body, a garment, or like, aside from being worn around the neck of the human body.

Figure 4:
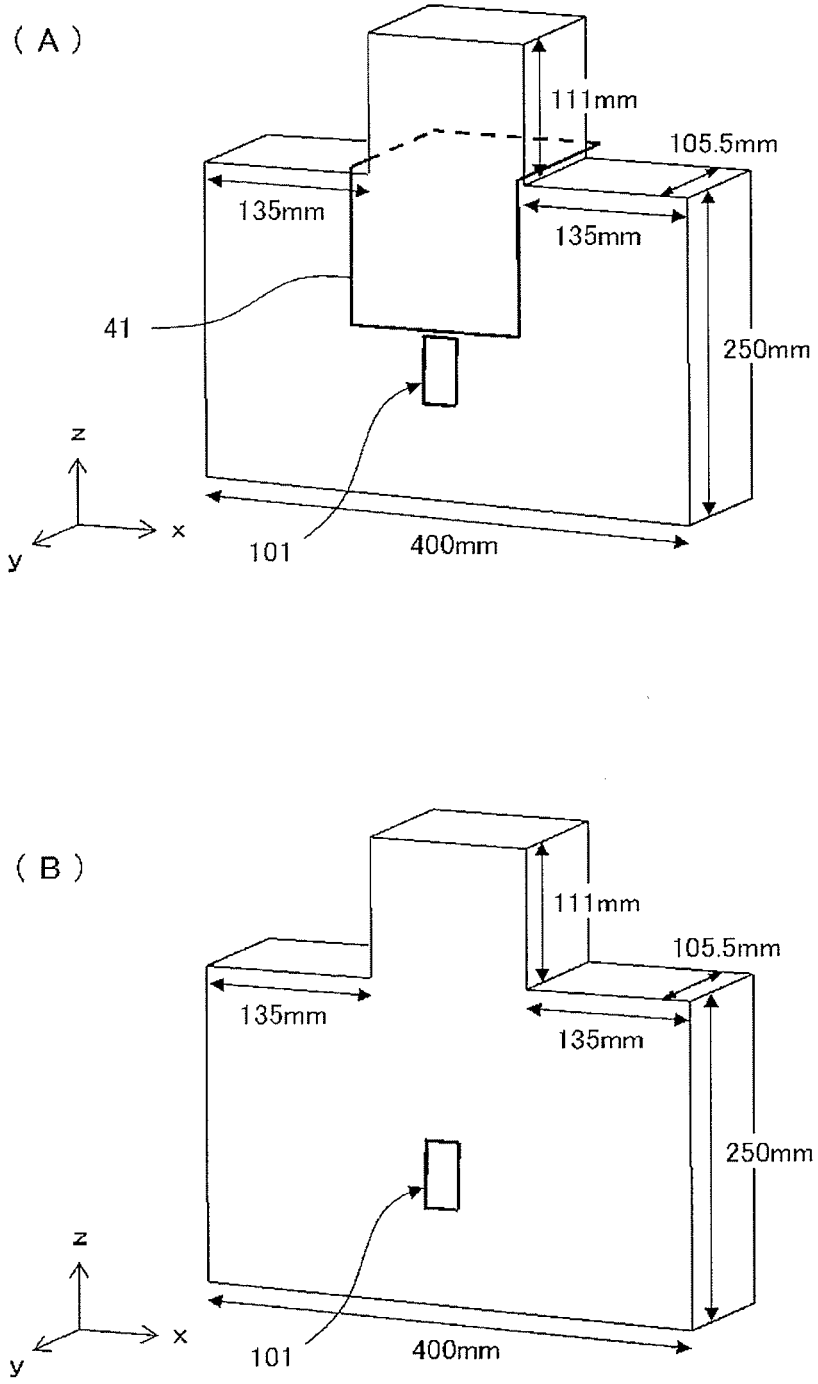
FIG. 4(A) is a diagram illustrating a state where the loop-shaped conductor 41 is provided in a neck strap and the stated neck strap is worn around the neck of a human body model (virtual human body).
FIG. 4(B) is a comparative example thereof, illustrating a state where only the communication module 101 is disposed without the loop-shaped conductor being provided.

FIG. 4(A) is a diagram illustrating a state where the loop-shaped conductor 41 is provided in a neck strap and the stated neck strap is worn around the neck of a human body model (virtual human body). FIG. 4(B) is a comparative example thereof, illustrating a state where only the communication module 101 is disposed without the loop-shaped conductor being provided. The communication module 101 is disposed at a position distanced by 9 mm from the surface of the human body (chest). At a frequency of 2450 MHz, relative permittivity $\epsilon r$ of the human model is 30.2 and electric conductivity $\sigma$ thereof is 1.8 [S/m].

Figure 5:
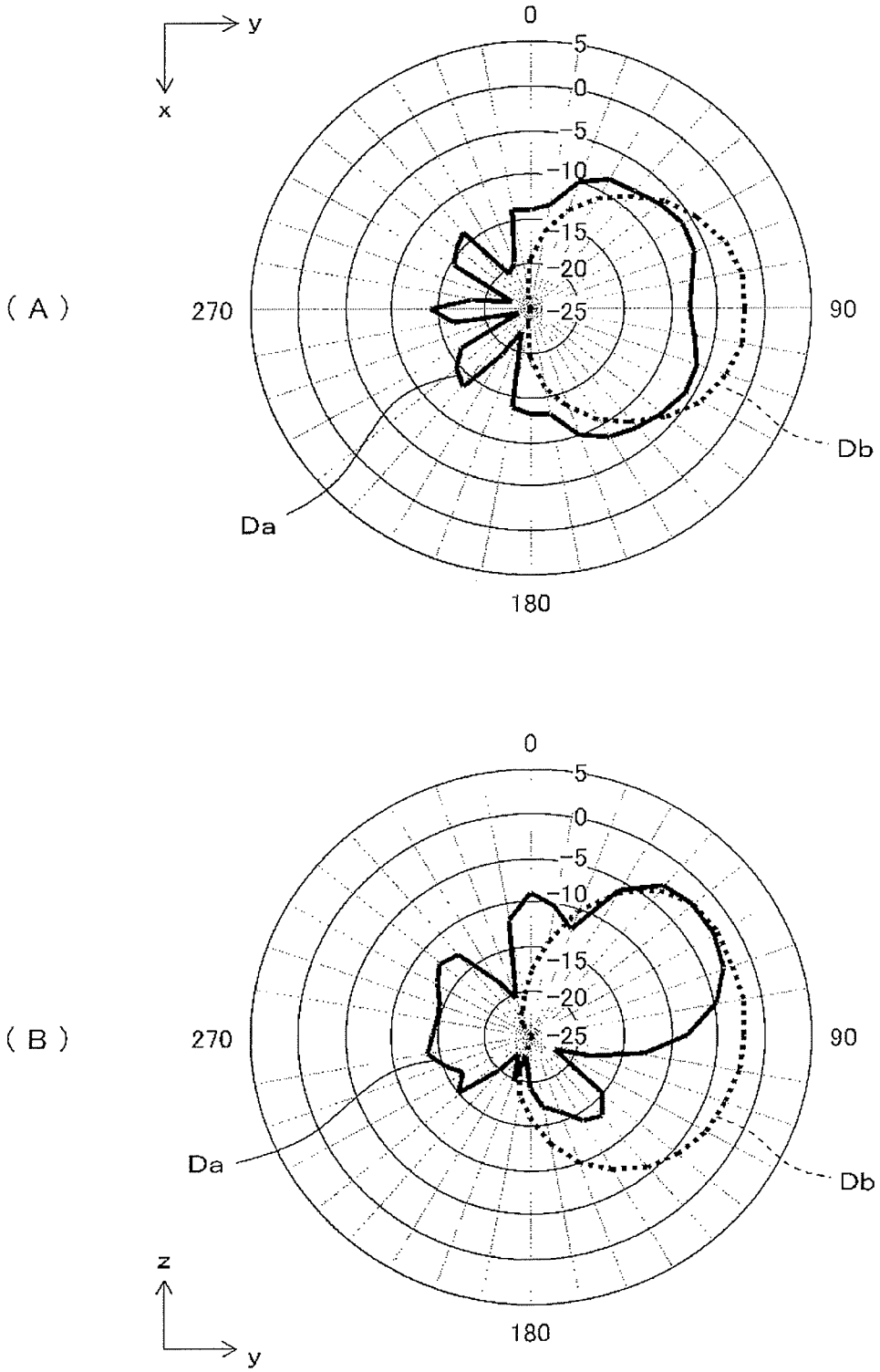
FIGS. 5(A) and 5(B) are diagrams illustrating directivity of the antenna devices being set in the states as shown in FIGS. 4(A) and 4(B)

FIGS. 5(A) and 5(B) are diagrams illustrating directivity of vertically polarized waves of the antenna device when being set in the states as shown in FIGS. 4(A) and 4(B). FIG. 5(A) illustrates directivity on an x-y plane (horizontal plane) when viewed from top of the head, while FIG. 5(B) illustrates directivity on a z-y plane (vertical plane) when viewed from the right side. In both the drawings, the characteristic Da indicates the directivity of the antenna device of the present embodiment, while the characteristic Db indicates the directivity of the antenna device as the comparative example. The measurement unit is dBi.

As shown in the drawings, in the case where the loop-shaped conductor 41 is bent and extended from the shoulders to the rear side of the neck, a gain toward the rear side of the human body (toward the side of the back) is raised. This is because a part of the neck strap is exposed to the rear side (to the side of the back) by wearing the neck strap around the neck. In other words, it can be considered that the part of the loop-shaped conductor 41 which is exposed to the rear side (to the side of the back) without being blocked by the human body contributes to the radiation.

Figure 6:
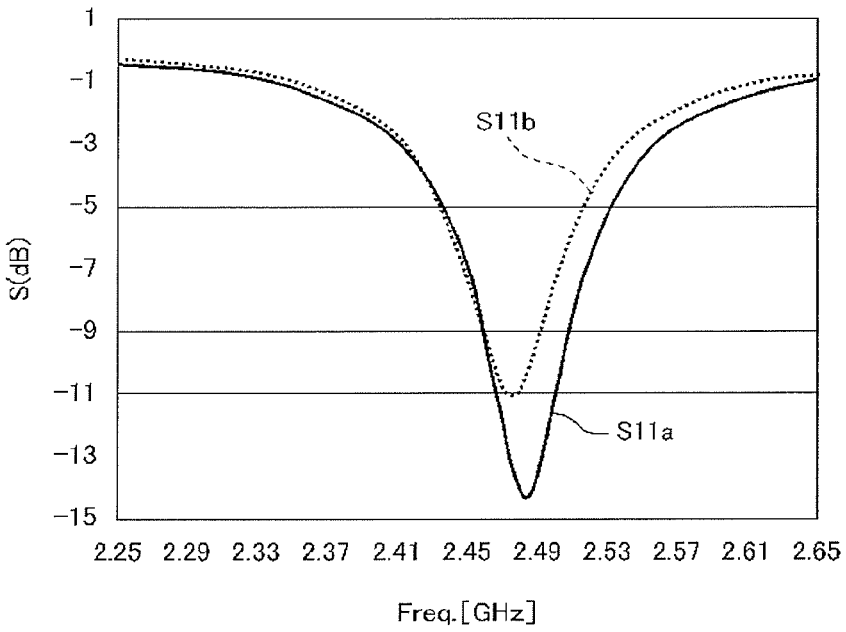
FIG. 6 is a diagram illustrating frequency characteristics of return loss (S11) of the antenna device according to the first embodiment.

FIG. 6 is a diagram illustrating frequency characteristics of return loss (S11) of the antenna device of the present embodiment. In FIG. 6, a characteristic S11*a* indicates return loss of the antenna device of the present embodiment, while a characteristic S11*b* indicates return loss of the antenna device as the comparative example. Providing the loop-shaped conductor 41 in the manner described above makes it possible to expand the frequency bandwidth while the center frequency being kept constant. It can be considered that an effect such that radiation Q is lowered as an antenna volume increases contributes to the above result.

Second Embodiment

Figure 7:
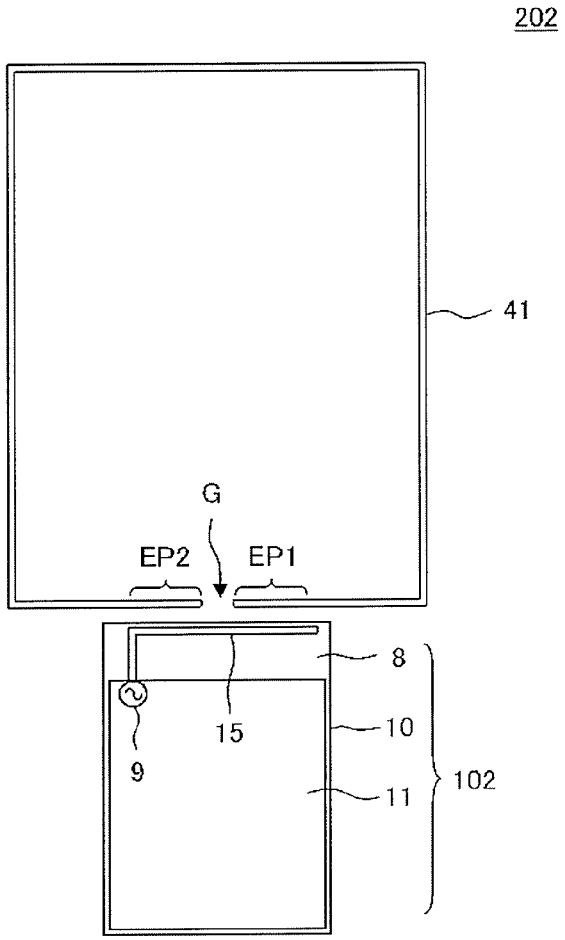
FIG. 7 is a diagram illustrating the principal constituent elements of an antenna device 202 according to a second embodiment.

FIG. 7 is a diagram illustrating the principal constituent elements of an antenna device 202 according to a second embodiment. In FIG. 7, the antenna device 202 includes a communication module 102 and the loop-shaped conductor 41. The communication module 102 has the substrate 10 on which the approximately rectangular ground conductor 11 is formed. The non-ground region 8 is provided along one side of the ground conductor 11. A radiation element 15 is formed in the non-ground region 8. The feeder circuit 9 is provided on the substrate 10, and power is fed to the radiation element 15 by the feeder circuit 9. The radiation element 15 acts as a radiation element of a monopole antenna. Further, a portion near an open end of the radiation element 15 and an end portion EP1 of the loop-shaped conductor 41 which is near the gap G and is in the vicinity of the above portion of the radiation element 15, mainly form electric field coupling. Although intensity of electric field is weak in the vicinity of a feeding end of the radiation element 15, this end is also coupled to another end portion EP2 near the gap G of the loop-shaped conductor 41.

The radiation element 15 resonates at a quarter-wavelength and forms an image on the ground conductor 11 so as to perform dipole operation.

Figure 8:
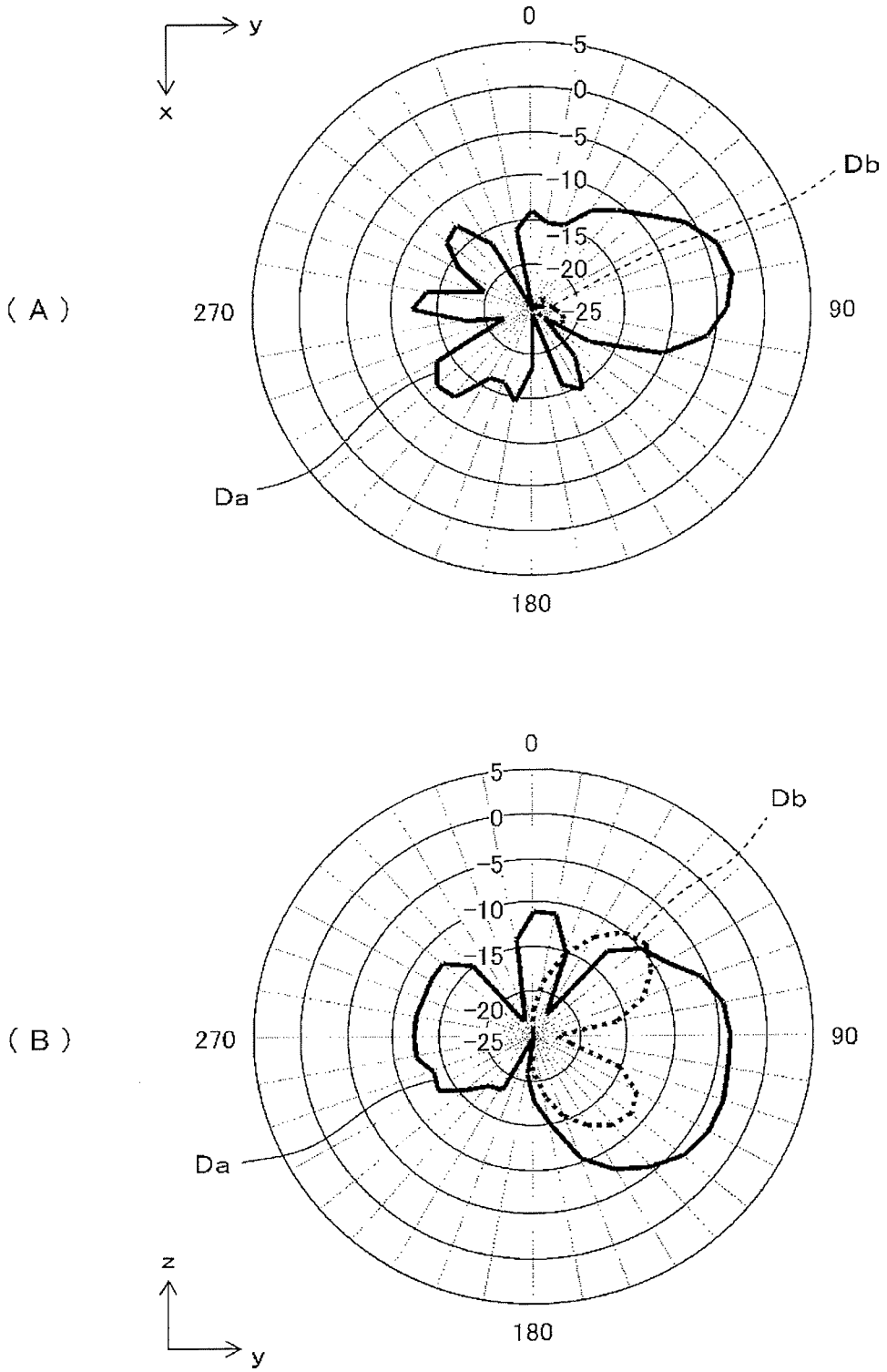
FIGS. 8(A) and 8(B) are diagrams illustrating directivity of the antenna device 202.

In the antenna device of the second embodiment, directivity was measured under the same conditions as those illustrated in FIGS. 4(A) and 4(B) of the first embodiment. FIGS. 8(A) and 8(B) are diagrams illustrating the measurement results. FIG. 8(A) illustrates directivity on an x-y plane (horizontal plane) when viewed from top of the head, while FIG. 8(B) illustrates directivity on a z-y plane (vertical plane) when viewed from the right side. In both the drawings, the characteristic Da indicates the directivity of the antenna device of the present embodiment, while the characteristic Db indicates the directivity of the antenna device as the comparative example. The measurement unit is dBi.

In the case where the loop-shaped conductor 41 is bent and extended from the shoulders to the rear side of the neck in the manner described above, a gain toward the rear side of the human body (toward the side of the back) is raised. This is because a part of the neck strap is exposed to the rear side (to the side of the back) by wearing the neck strap around the neck. In other words, it can be considered that the radiation at the part of the loop-shaped conductor 41 which is exposed to the rear side (to the side of the back) without being blocked by the human body contributes to the above result.

Figure 9:
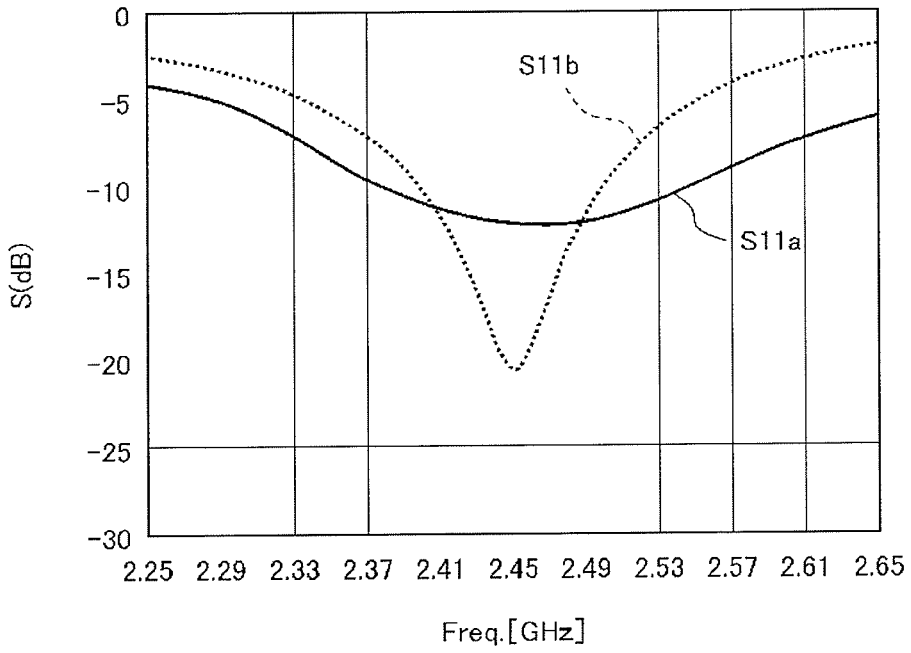
FIG. 9 is a diagram illustrating frequency characteristics of return loss (S11) of the antenna device according to the second embodiment.

FIG. 9 is a diagram illustrating frequency characteristics of the return loss (S11) of the antenna device of the present embodiment. In FIG. 9, the characteristic S11*a* indicates return loss of the antenna device of the present embodiment, while the characteristic S11*b* indicates return loss of the antenna device as the comparative example. Providing the loop-shaped conductor 41 in the manner described above makes it possible to expand the frequency bandwidth while the center frequency being kept constant.

Third Embodiment

Figure 10:
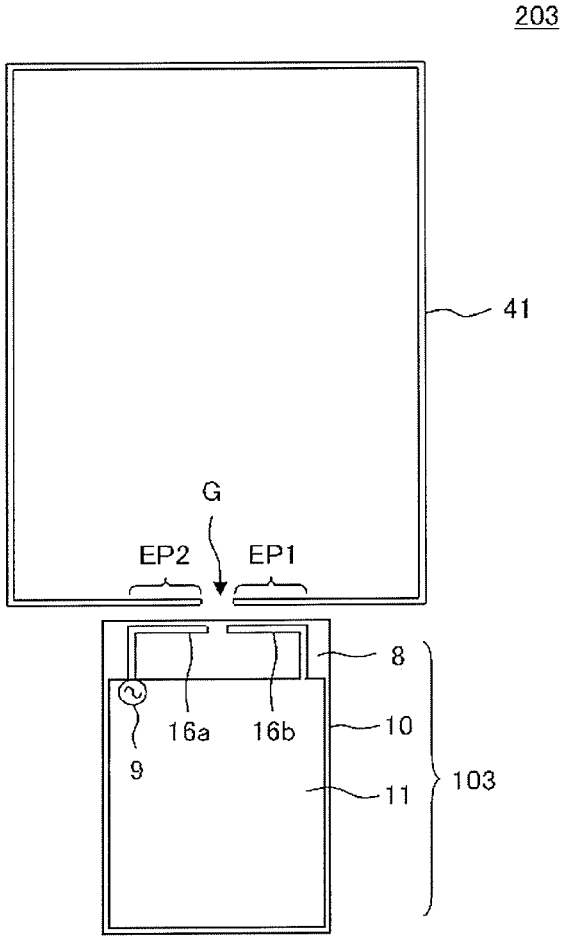
FIG. 10 is a diagram illustrating the principal constituent elements of an antenna device 203 according to a third embodiment.

FIG. 10 is a diagram illustrating the principal constituent elements of an antenna device 203 according to a third embodiment. In FIG. 10, the antenna device 203 includes a communication module 103 and the loop-shaped conductor 41. The communication module 103 has the substrate 10 on which the approximately rectangular ground conductor 11 is formed. The non-ground region 8 is provided along one side of the ground conductor 11. Radiation elements 16*a* and 16*b* are formed in the non-ground region 8. The feeder circuit 9 is provided on the substrate 10, and the radiation element 16*a* is fed with power by the feeder circuit 9. The radiation element 16*b* is a non-power fed radiation element, and one end thereof is connected to the ground conductor 11 (grounded) while the other end is open. The open end of the radiation element 16*b* is near an open end of the radiation element 16*a*; the radiation element 16*b* is fed with power through capacitance generated between both the open ends. The respective radiation elements 16*a* and 16*b* resonate at a quarter-wavelength and mainly form electric field coupling with the respective end portions of the loop-shaped conductor 41 near the gap G. The ground conductor 11 also acts as a radiation element.

Figure 11:
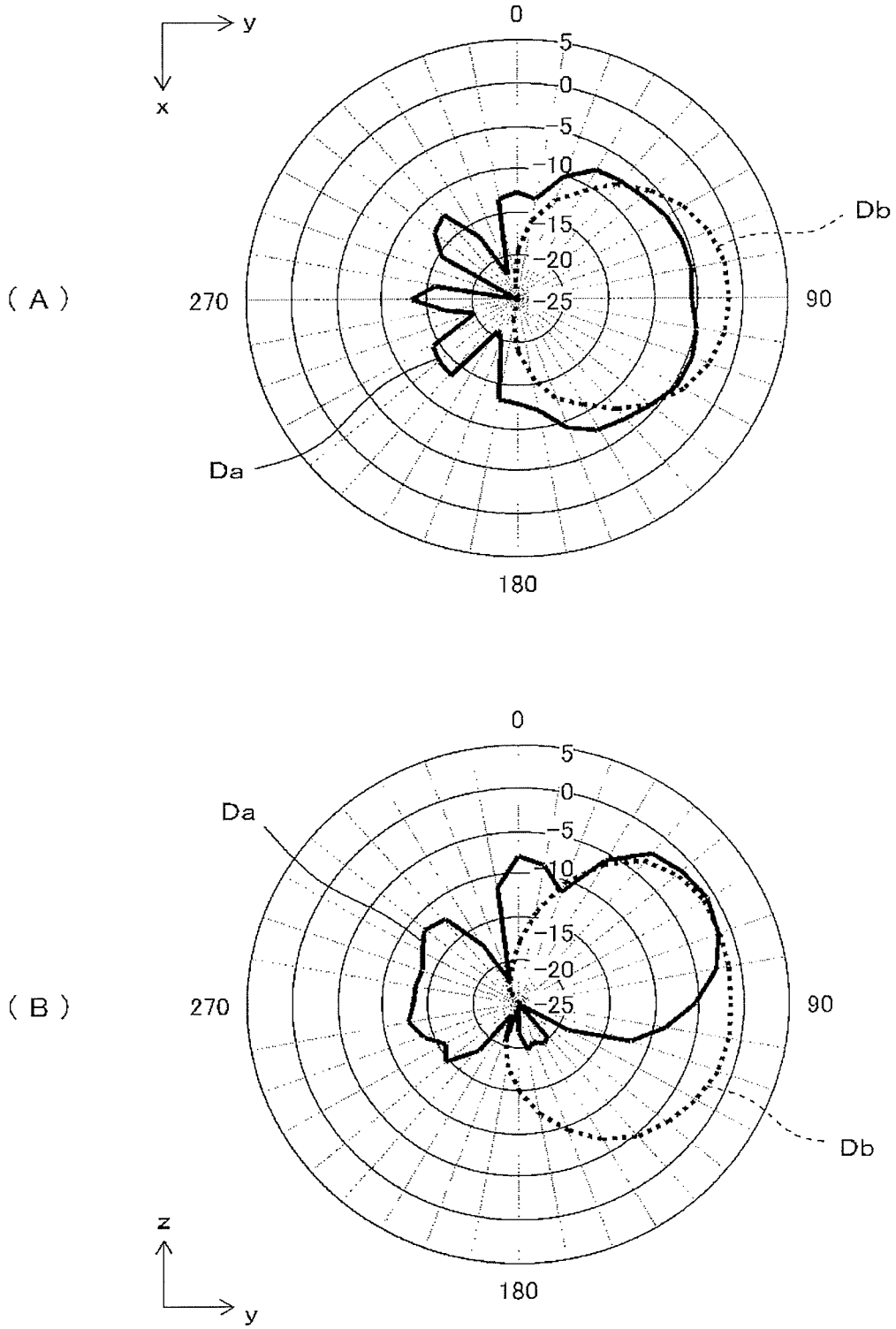
FIGS. 11(A) and 11(B) are diagrams illustrating directivity of the antenna device 203.

In the antenna device of the third embodiment, directivity was measured under the same conditions as those illustrated in FIGS. 4(A) and 4(B) of the first embodiment. FIGS. 11(A) and 11(B) are diagrams illustrating the measurement results. FIG. 11(A) illustrates directivity on an x-y plane (horizontal plane) when viewed from top of the head, while FIG. 11(B) illustrates directivity on a z-y plane (vertical plane) when viewed from the right side. In both the drawings, the characteristic Da indicates the directivity of the antenna device of the present embodiment, while the characteristic Db indicates the directivity of the antenna device as the comparative example. The measurement unit is dBi.

In the case where the loop-shaped conductor 41 is bent and extended from the shoulders to the rear side of the neck in the manner described above, a gain toward the rear side of the human body (toward the side of the back) is raised. This is because a part of the neck strap is exposed to the rear side (to the side of the back) by wearing the neck strap around the neck. In other words, it can be considered that the part of the loop-shaped conductor 41 which is exposed to the rear side (to the side of the back) without being blocked by the human body contributes to the radiation.

Fourth Embodiment

Figure 12:
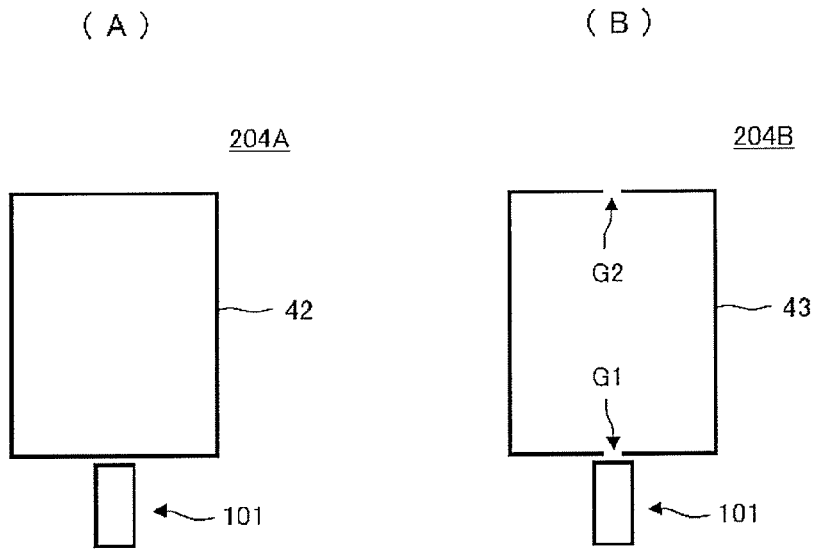
FIGS. 12(A) and 12(B) are diagrams respectively illustrating the principal constituent elements of antenna devices according to a fourth embodiment.

In a fourth embodiment, loop-shaped conductors having different shapes from each other will be described as examples. FIGS. 12(A) and 12(B) are diagrams each illustrating the principal constituent elements of antenna devices according to the fourth embodiment. In the antenna device illustrated in FIG. 12(A), a loop-shaped conductor 42 does not have a gap and is formed in a closed loop. A part of the loop-shaped conductor 42 is arranged at a position near the radiation element of the communication module 101. In the antenna device illustrated in FIG. 12 (B), two gaps G1 and G2 are each formed at the positions distanced the most from each other. Of the two gaps, the gap G1 is positioned near the radiation element of the communication module 101.

Figure 13:
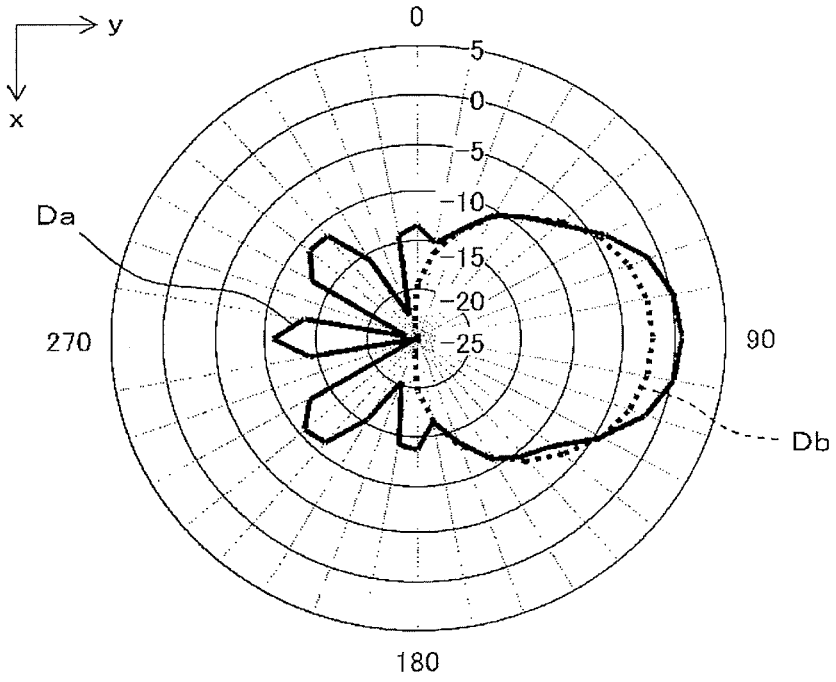
FIGS. 13(A) and 13(B) are diagrams illustrating directivity of an antenna device 204A shown in FIG. 12(A).
Figure 13:
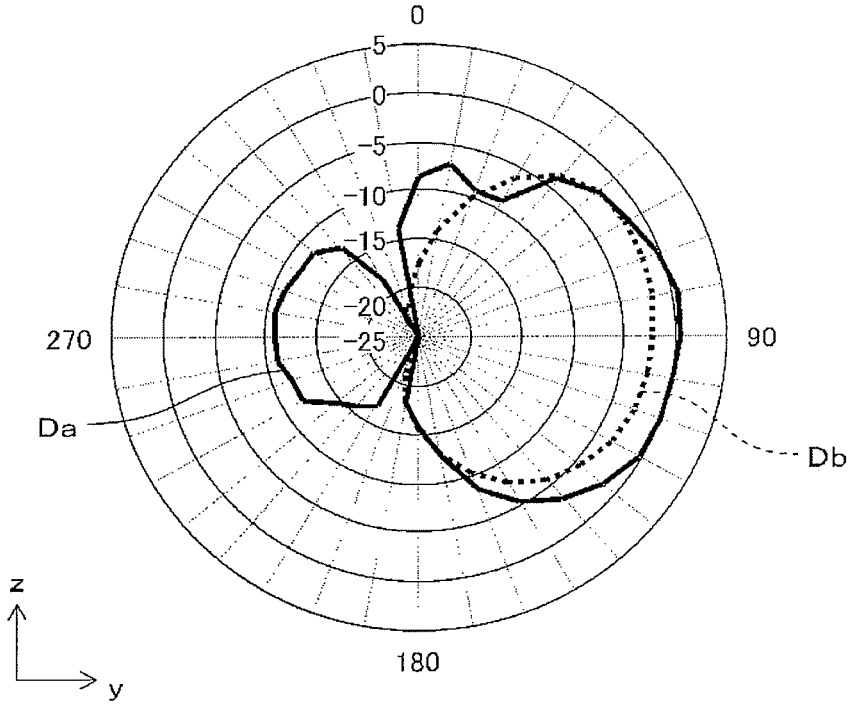
Figure 14:
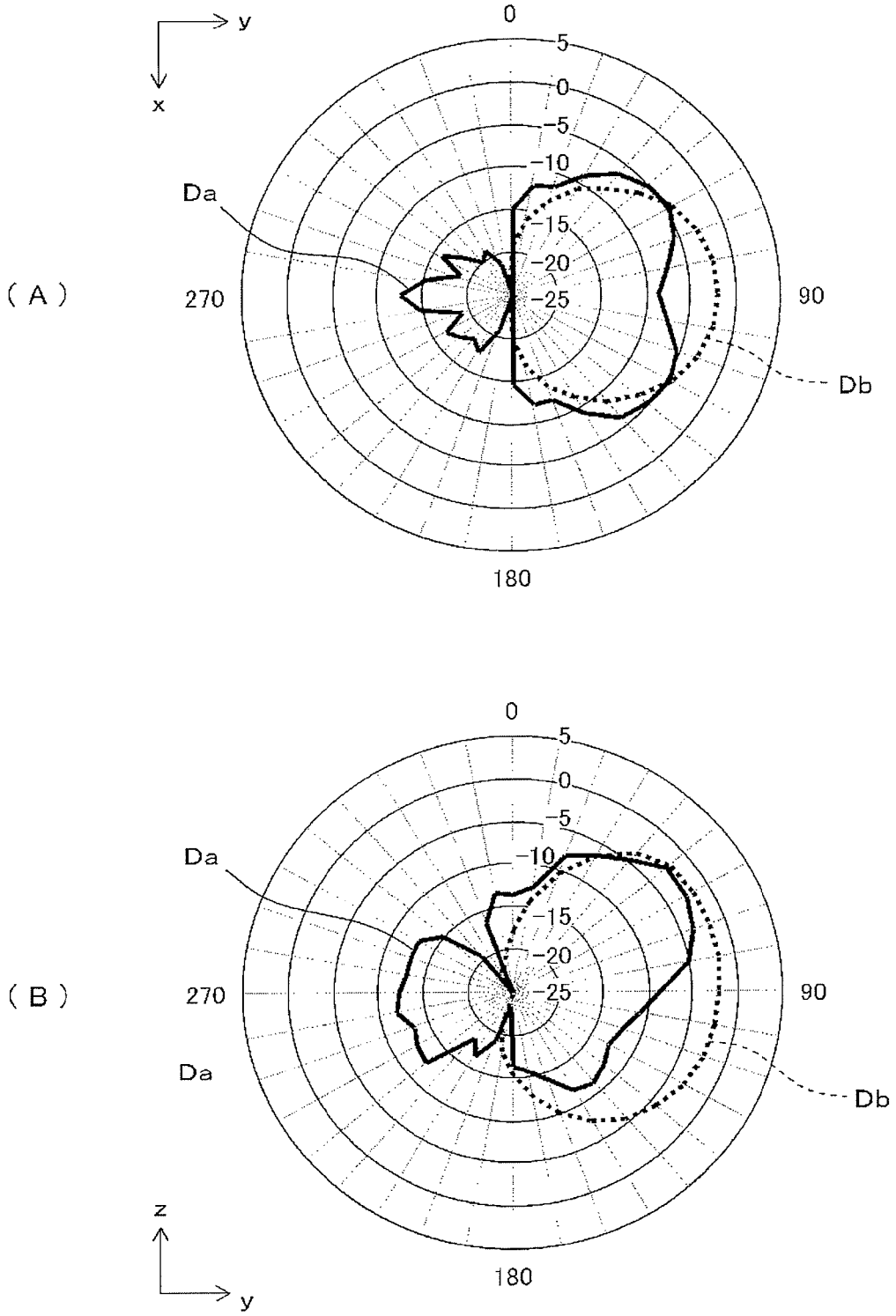
FIGS. 14(A) and 14(B) are diagrams illustrating directivity of an antenna device 204B shown in FIG. 12(B).

In the antenna devices of the fourth embodiment, directivity was measured under the same conditions as those illustrated in FIGS. 4(A) and 4(B) of the first embodiment. FIGS. 13(A), 13(B) and FIGS. 14(A), 14(B) are diagrams illustrating the measurement results. FIGS. 13(A), 13(B) are the diagrams illustrating directivity of vertically polarized waves of an antenna device 204A shown in FIG. 12(A), while FIGS. 14(A), 14(B) are the diagrams illustrating directivity of vertically polarized waves of an antenna device 204B shown in FIG. 12(B). FIGS. 13(A) and 14(A) each illustrate directivity on an x-y plane (horizontal plane) when viewed from top of the head, while FIGS. 13(B) and 14(B) each illustrate directivity on a z-y plane (vertical plane) when viewed from the right side. In the respective drawings, the characteristic Da indicates the directivity of the antenna device of the present embodiment, while the characteristic Db indicates the directivity of the antenna devices as the comparative examples. The measurement unit is dBi.

As is clarified by comparing FIGS. 13(A) and 13(B), FIGS. 14(A) and 14(B), and FIGS. 5(A) and 5(B) illustrated in the first embodiment with one another, a gain toward the rear side of the human body (toward the side of the back) can be obtained in either case. Further, it can be understood that the gain of the antenna device 204A including the loop-shaped conductor 42 without a gap, as shown in FIG. 12(A), is the largest.

Fifth Embodiment

Figure 15:
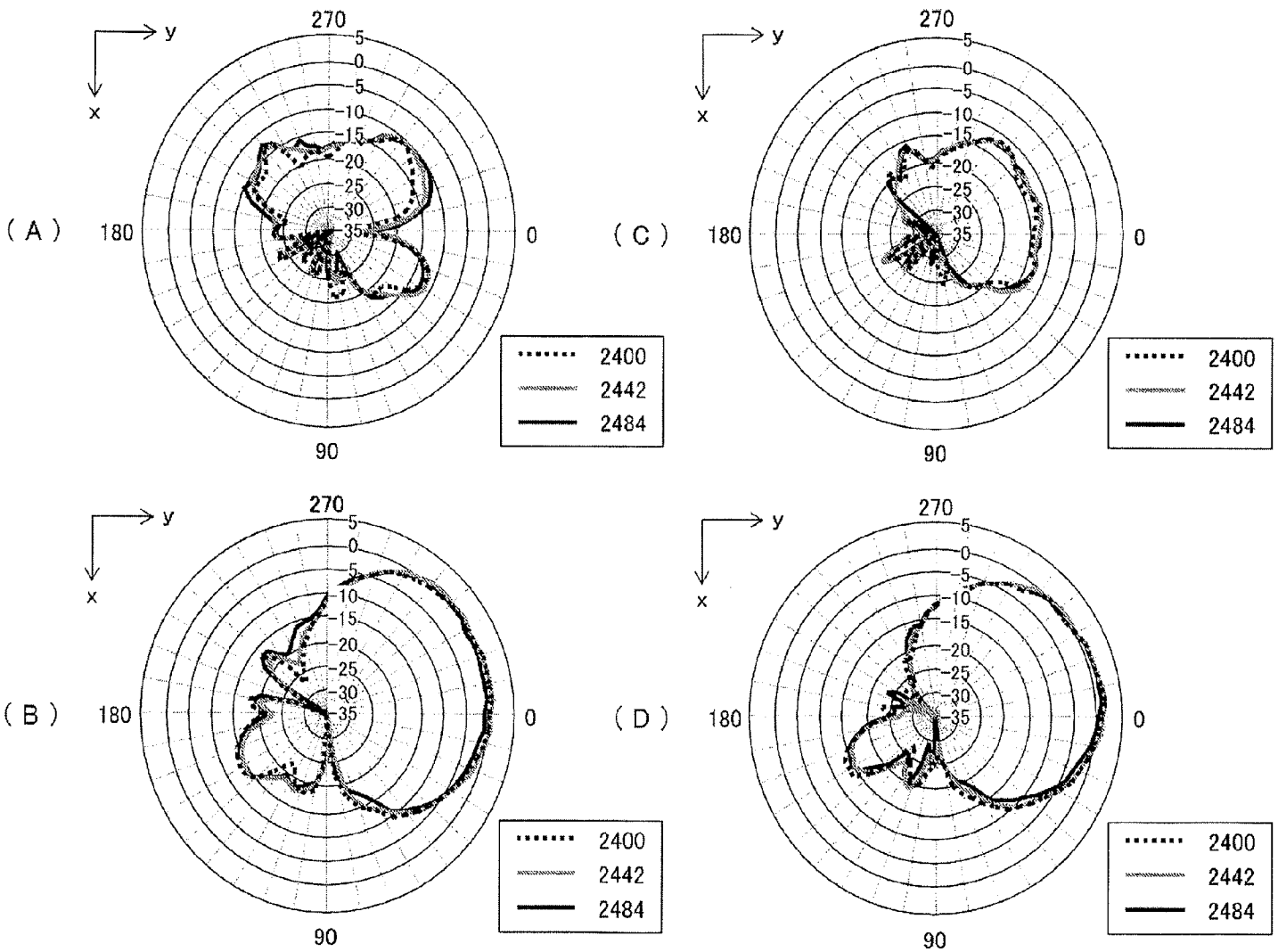
Figure 16:
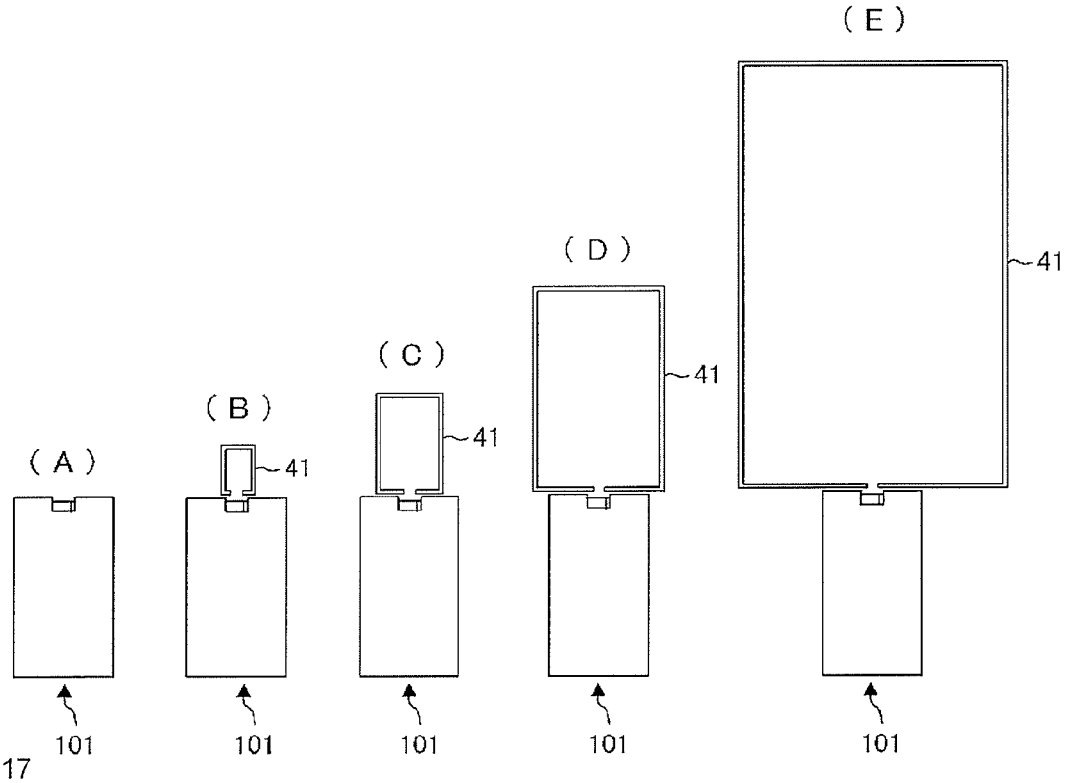
FIGS. 16(A) through 16(E) are diagrams illustrating examples of antenna devices with the loop-shaped conductors 41 having different sizes from each other.

In a fifth embodiment, examples of directivity of each polarized wave obtained through actual measurement will be described. Here, in the antenna device of the first embodiment, directivity of each polarized wave was measured using an electromagnetic phantom (virtual human body) of a size of the average adult body shape. The communication module was disposed in the center of the chest portion, and the measurement was carried out with the loop-shaped conductor worn around the neck. FIGS. 15(A) and 15(B) are diagrams illustrating characteristics of the antenna device of the first embodiment (having a loop-shaped conductor), while FIGS. 15(C) and 15(D) are diagrams illustrating characteristics of an antenna device as a comparative example (not having a loop-shaped conductor). FIGS. 15(A) and 15(C) indicate the directivity of horizontally polarized waves, while FIGS. 15(B) and 15(D) indicate the directivity of vertically polarized waves.

According to the results obtained through the actual measurement, it was also confirmed that gains toward the rear side (toward the side of the back) (in a −y direction) are produced in both the horizontally polarized waves and the vertically polarized waves.

Sixth Embodiment

In a sixth embodiment, a relationship between a size of a loop-shaped conductor and antenna efficiency will be described. FIGS. 16(A) through 16(E) are diagrams illustrating examples of antenna devices with the loop-shaped conductors 41 having different sizes from each other. The sizes of the loop-shaped conductors 41 of the respective antenna devices shown in FIG. 16(A) through FIG. 16(E) are as follows.

(A) None
(B) 15.25 mm×9.25 mm
(C) 31.25 mm×18.75 mm
(D) 62.5 mm×37.5 mm
(E) 125 mm×75 mm The configuration and size of the communication module 101 are the same as those described in the first embodiment.

Figure 17:
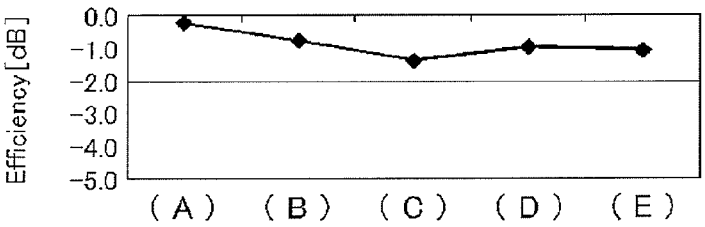
FIG. 17 is a diagram illustrating antenna efficiency of the respective antenna devices shown in FIGS. 16(A) through 16(E).

FIG. 17 is a diagram illustrating antenna efficiency of the respective antenna devices shown in FIGS. 16(A) through 16(E). As shown in the drawing, the antenna efficiency changes only by approximately −1.0 dB depending on the presence/absence of the loop-shaped conductor 41, the size thereof, and so on. Accordingly, the antenna efficiency is hardly lowered.

Seventh Embodiment

In a seventh embodiment, a relationship between directivity and the distance "d" between a loop-shaped conductor and a communication module, a relationship between directivity and the dimension "g" of the gap G of a loop-shaped conductor, and a relationship between directivity and the size of a loop-shaped conductor will be individually described.

Here, the configuration of the antenna device is the same as that illustrated in FIG. 1. The size of the communication module is also the same as that described in the first embodiment. The manner in which coordinates x, y, and z are taken corresponds to the manner as illustrated in FIG. 1. The characteristic Da indicates directivity of the antenna device having a loop-shaped conductor, while the characteristic Db indicates directivity of the antenna device without a loop-shaped conductor as a comparative example.

Figure 18:
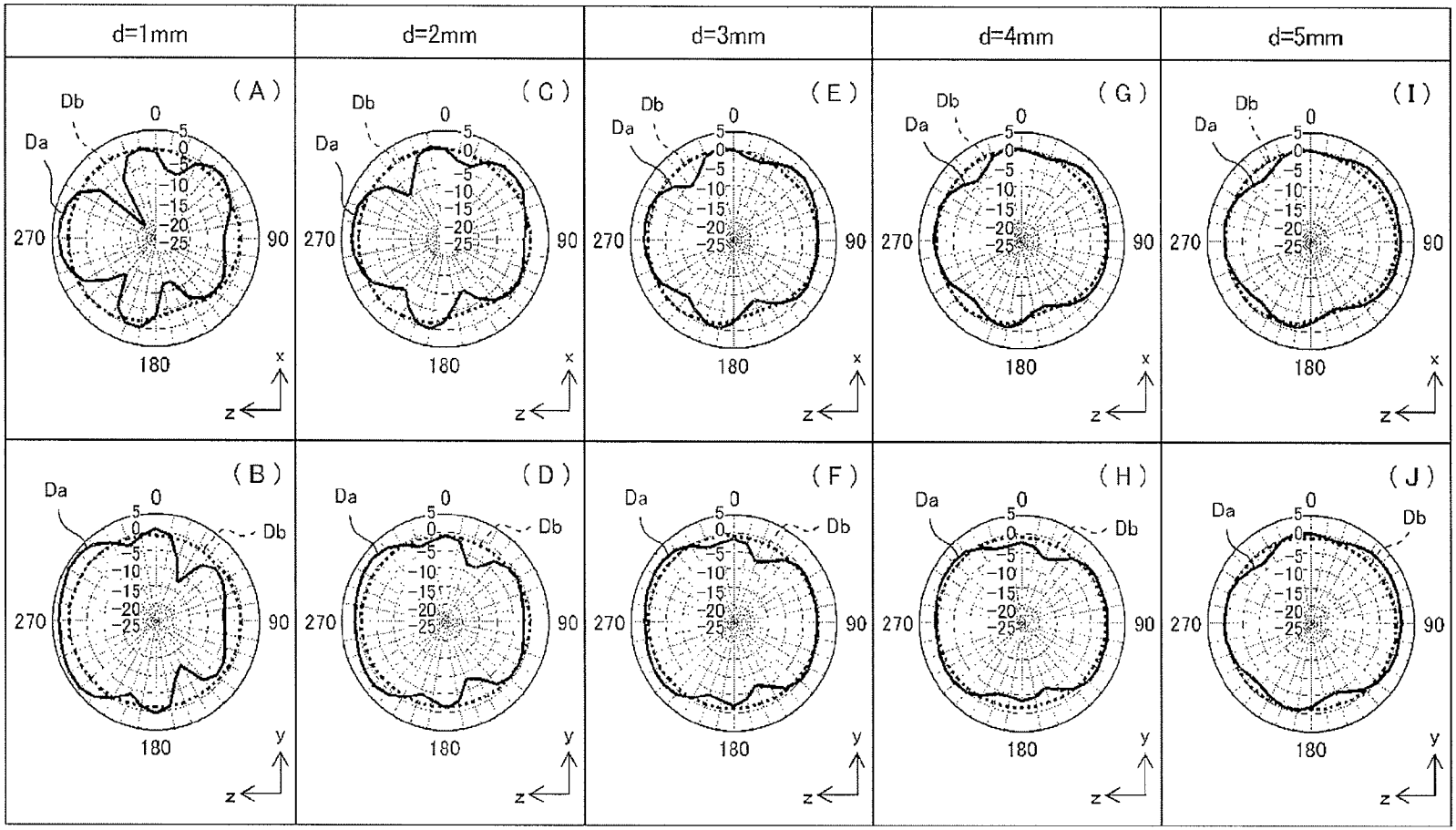
FIG. 18 is a diagram illustrating a relationship between directivity and a distance "d" between the loop-shaped conductor and the communication module.

FIG. 18 is a diagram illustrating the relationship between directivity and the distance "d" between the loop-shaped conductor and the communication module. Here, the dimension "g" of the gap G of the loop-shaped conductor is set to a constant value of 2 mm and the size of the loop-shaped conductor is set to a constant value of 125 mm×75 mm. As understood from FIG. 18, as the distance "d" between the loop-shaped conductor and the communication module becomes smaller, an effect that improves a gain in a z direction (direction along which the loop-shaped conductor extends) becomes larger. In the case where $d<5$ mm, that is, "d" is no more than approximately $0.05\lambda$, at a frequency of 2450 MHz, the gain in the z direction is improved. Note that the efficiency is substantially constant to be −1.1 dB if "d" is in the above range.

Figure 19:
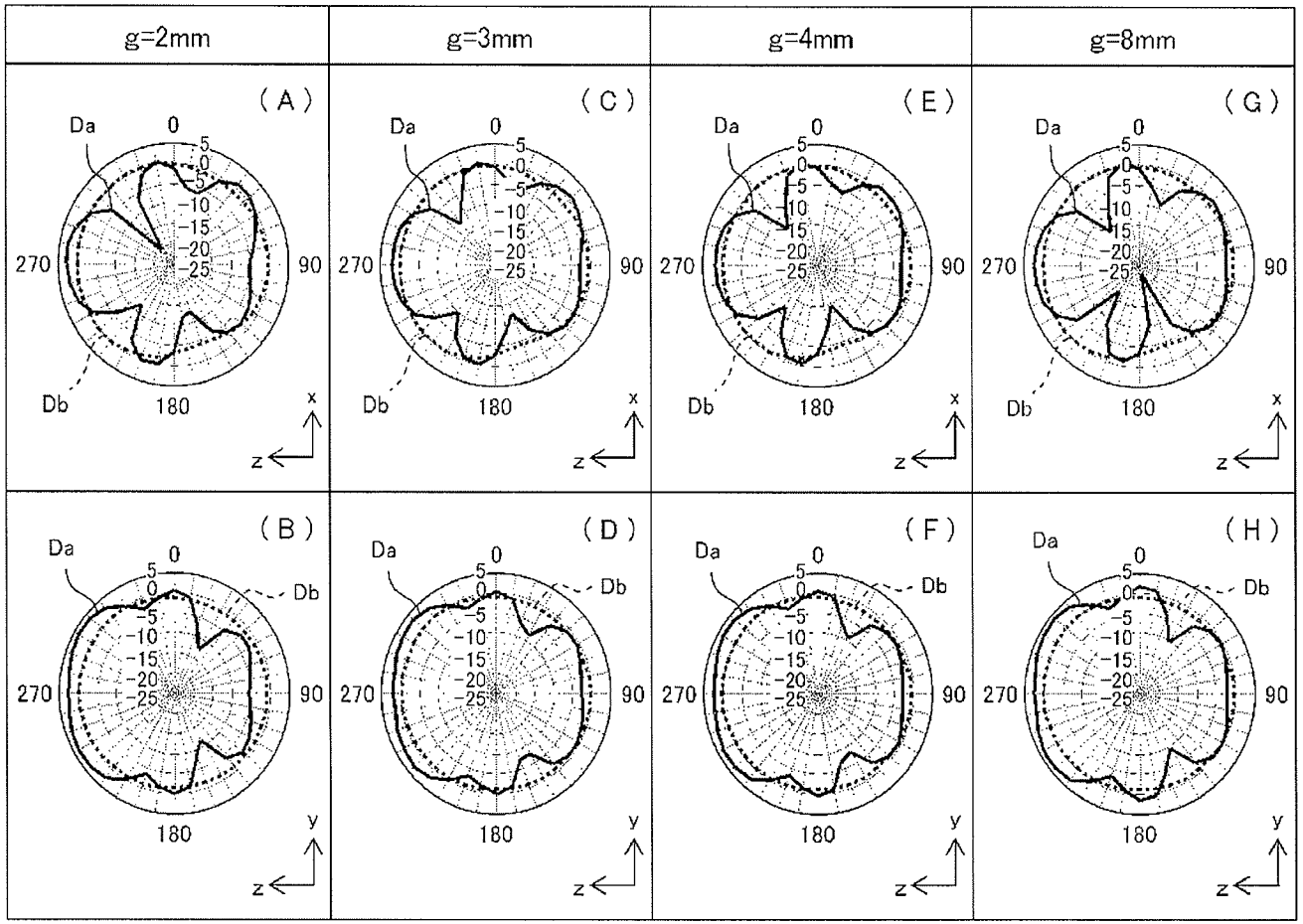
FIG. 19 is a diagram illustrating a relationship between directivity and a dimension "g" of a gap G in the loop-shaped conductor.

FIG. 19 is a diagram illustrating the relationship between directivity and the dimension "g" of the gap G in the loop-shaped conductor. Here, the distance "d" between the loop-shaped conductor and the communication module is set to a constant value of 1 mm and the size of the loop-shaped conductor is set to a constant value of 125 mm×75 mm. As understood from FIG. 19, as the dimension "g" of the gap G in the loop-shaped conductor becomes smaller, an effect that improves a gain in the z direction (direction along which the loop-shaped conductor extends) becomes larger. It is also understood that a change in pattern of the directivity is small when the gap dimension "g" changes from 2 mm to 8 mm. In addition, the efficiency is substantially constant to be −1.1 dB if "g" is in the above range. As described thus far, providing a gap in the loop-shaped conductor makes it possible to control the directivity in accordance with the size of the gap without changing the length of the circumference of the loop-shaped conductor.

Figure 20:
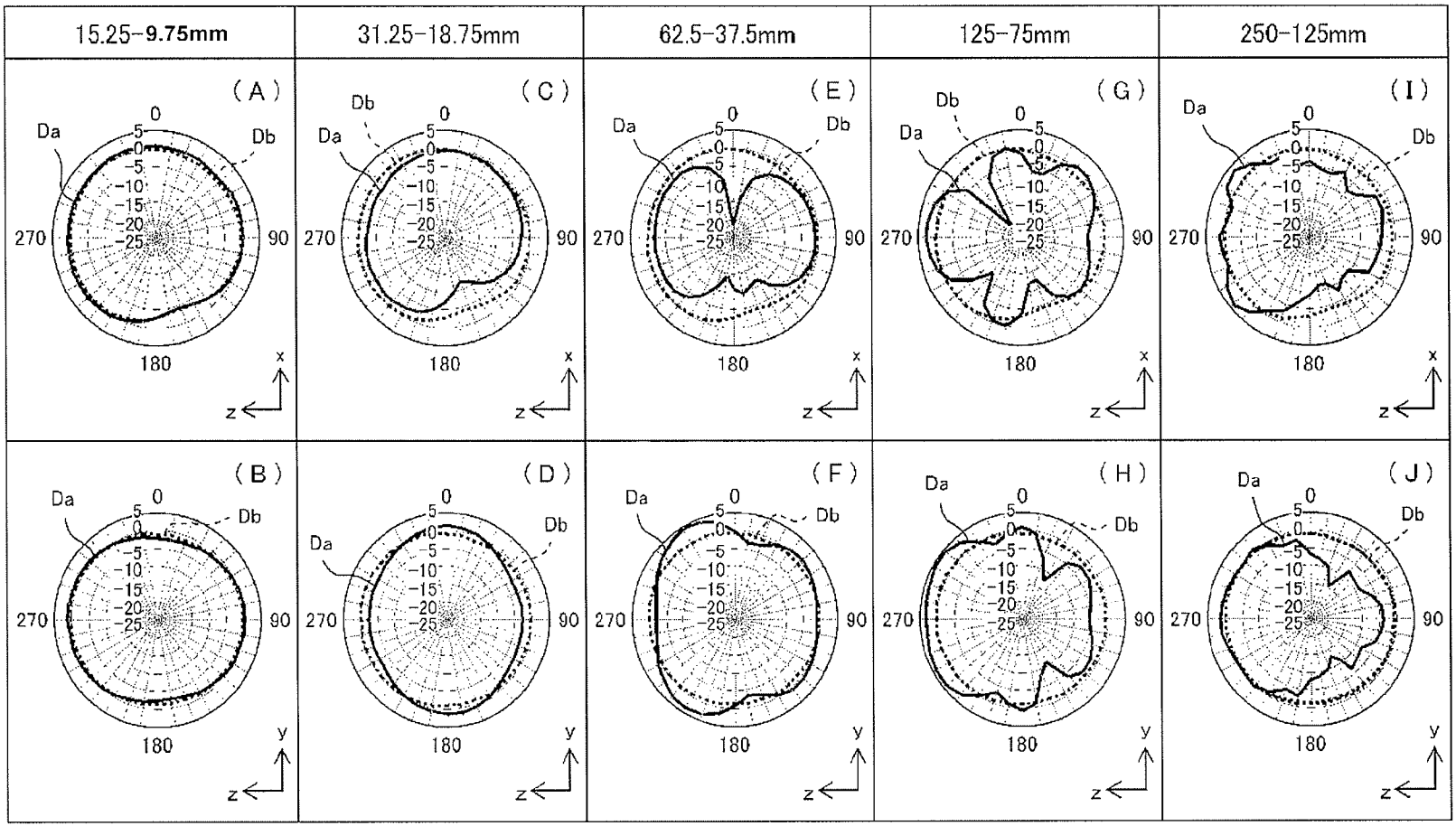
FIG. 20 is a diagram illustrating a relationship between directivity and a size of the loop-shaped conductor.

FIG. 20 is a diagram illustrating the relationship between directivity and the size of the loop-shaped conductor. Here, the dimension "g" of the gap G of the loop-shaped conductor is set to a constant value of 2 mm and the distance "d" between the loop-shaped conductor and the communication module is set to a constant value of 1 mm. As understood from FIG. 20, there is little change in the directivity when the size of the loop-shaped conductor is 15.25 mm×9.75 mm (length of the circumference is 25 mm), but the change in the directivity can be seen when the size thereof is 31.25 mm×18.75 mm (length of the circumference is 100 mm). Therefore, it is understood that the directivity can be changed when the length of the circumference is no less than 60 mm, which is a value in the middle between the above-mentioned two lengths; that is, the directivity can be changed at no less than 0.5λ.

Eighth Embodiment

Figure 21:
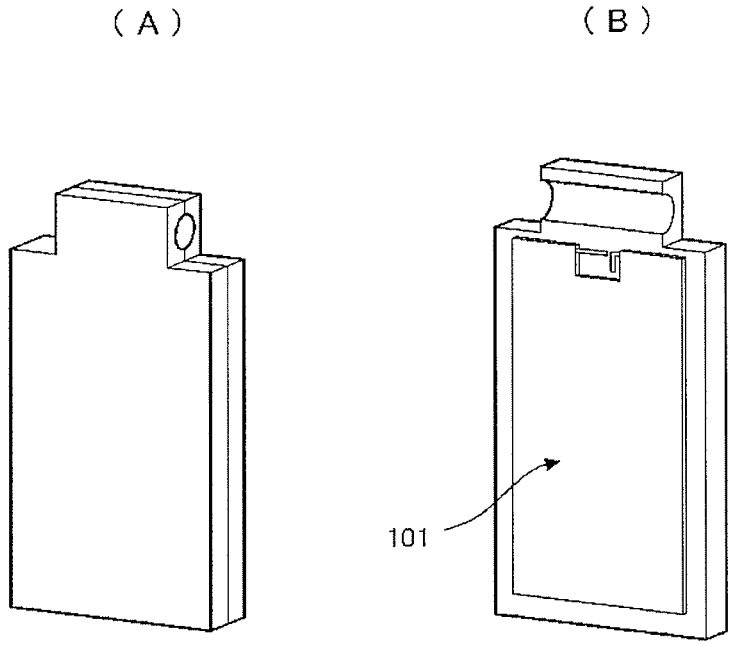

In an eighth embodiment, a configuration of an electronic apparatus equipped with the above-described antenna device will be described. FIG. 21(A) is a perspective view illustrating a housing of the communication module as a part of the electronic apparatus, while FIG. 21(B) is a perspective view illustrating a rear-side section of the housing when the housing is separated into two sections. The communication module 101 is accommodated in the housing, and there is provided a hole into which a neck strap is inserted (for nipping the strap) in the vicinity of the radiation element of the communication module. A loop-shaped conductor is provided in the interior of the neck strap.

Figure 22:
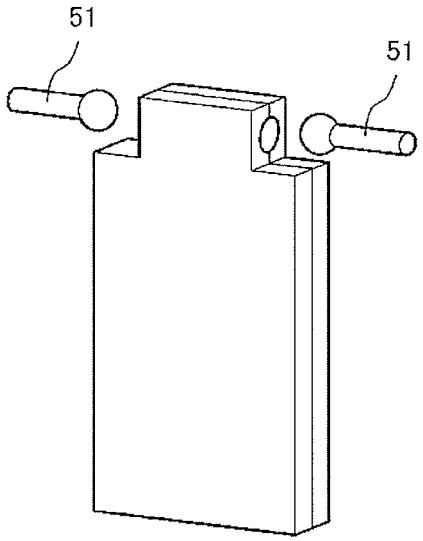
FIG. 22 is a perspective view of another electronic apparatus, illustrating a state in which a neck strap is about to be attached to a housing.
Figure 23:
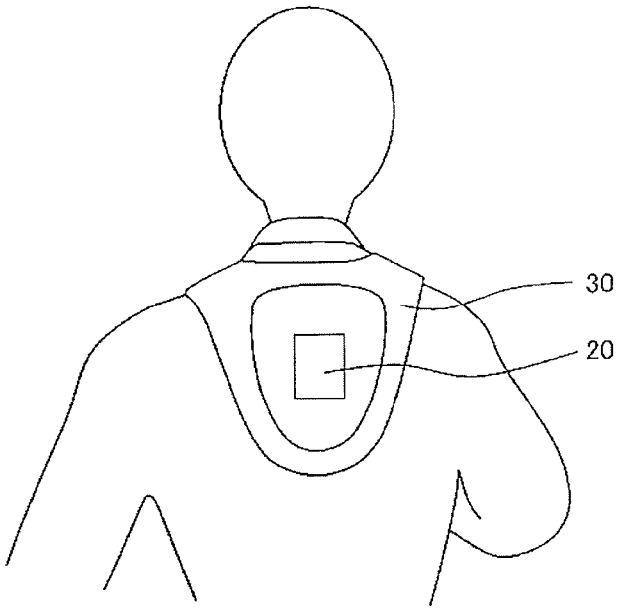
FIG. 23 is a diagram illustrating a usage state of an antenna device disclosed in Patent Document 1.

FIG. 22 is a perspective view of another electronic apparatus, illustrating a state in which a neck strap is about to be attached to a housing. Both ends of a neck strap 51 are round-shaped, and a loop-shaped conductor is provided in the interior thereof. The configuration of the housing is basically the same as that illustrated in FIG. 21; the round-shaped portions at both the ends of the neck strap 51 are fitted into the hole of the housing.

The neck strap is a member that is made by covering a stranded wire of copper or a net-formed copper wire with nylon 66 (registered trademark), polyester, or the like, for example.

REFERENCE SIGNS LIST

C1 CAPACITANCE ELEMENT
8 NON-GROUND REGION
9 FEEDER CIRCUIT
10 SUBSTRATE
11 GROUND CONDUCTOR
13 TRANSMISSION LINE
14, 15 RADIATION ELEMENT
16*a*, 16*b* RADIATION ELEMENT
41-43 LOOP-SHAPED CONDUCTOR
51 NECK STRAP
101-103 COMMUNICATION MODULE
201-203 ANTENNA DEVICE
204A, 204B ANTENNA DEVICE

The invention claimed is:

1. An antenna device comprising:
a ground conductor disposed on a substrate;
a non-ground region disposed on one side of the ground conductor;
a radiation element disposed in the non-ground region; and
a loop-shaped conductor positioned adjacent to the one side of the ground conductor where the non-ground region is disposed,
wherein the loop-shaped conductor comprises a gap disposed at a position in the loop-shaped conductor that is closest to the radiation element.

2. The antenna device according to claim 1, wherein the loop-shaped conductor does not overlap with the ground conductor.

3. The antenna device according to claim 1, wherein the ground conductor comprises an approximately rectangular shape.

4. The antenna device according to claim 1, wherein the loop-shaped conductor comprises a circumference with a length that is equal to or greater than half a wavelength of a frequency of the antenna device during operation.

5. The antenna device according to claim 1, further comprising a feeder circuit disposed on the substrate and configured to provide power to the radiation element.

6. The antenna device according to claim 5, further comprising a capacitance element disposed on the radiation element.

7. The antenna device according to claim 5, wherein the radiation element comprises an L-shape.

8. The antenna device according to claim 7, wherein the radiation element comprises an end that extends in a direction adjacent to an edge of the substrate, the edge being adjacent to loop-shaped conductor.

9. The antenna device according to claim 8, wherein the radiation element is configured to resonate at a quarter wavelength to perform a dipole operation.

10. The antenna device according to claim 5, wherein the radiation element comprises a first arm coupled to the feeder circuit and a second arm coupled to the ground conductor.

11. The antenna device according to claim 10, wherein the first arm has a first end and the second arm has a second end adjacent to the first end of the first arm and power is feed through capacitance between the first and second arms.

12. The antenna device according to claim 1, further comprising:
a feeder circuit disposed on the substrate and configured to provide power to the radiation element; and
a capacitance element disposed on the radiation element,
wherein the gap of the loop-shaped conductor is disposed adjacent to the capacitance element disposed on the radiation element.

13. The antenna device according to claim 1, further comprising:
a feeder circuit disposed on the substrate and configured to provide power to the radiation element, wherein the radiation element comprises an L-shape, wherein the radiation element comprises an end that extends in a direction adjacent to an edge of the substrate, the edge being adjacent to loop-shaped conductor, wherein the radiation element is configured to resonate at a quarter wavelength to perform a dipole operation, and wherein the gap of the loop-shaped conductor is disposed adjacent to the end of the radiation element.

14. The antenna device according to claim 1, further comprising:

a feeder circuit disposed on the substrate and configured to provide power to the radiation element, wherein the radiation element comprises a first arm coupled to the feeder circuit and a second arm coupled to the ground conductor, wherein the first arm has a first end and the second arm has a second end adjacent to the first end of the first arm and power is feed through capacitance between the first and second arms, and wherein the gap of the loop-shaped conductor is disposed adjacent to the first end of the first arm and the second end of the second arm of the radiation element.

15. An antenna device, comprising:

a ground conductor disposed on a substrate;

a non-ground region disposed on one side of the ground conductor;

a radiation element disposed in the non-ground region; and a loop-shaped conductor positioned adjacent to the one side of the ground conductor where the non-ground region is disposed, wherein the loop-shaped conductor is disposed in a strap that is configured to be worn around a user's neck.

16. The antenna device according to claim 15, wherein the radiation element is accommodated in a housing attached to the neck strap.

17. An electronic apparatus comprising:

a ground conductor;

a non-ground region disposed on one side of the ground conductor;

a radiation element disposed in the non-ground region; and a loop-shaped conductor positioned adjacent to the one side of the ground conductor where the non-ground region is disposed and not overlapping the ground conductor, wherein the loop-shaped conductor comprises a gap disposed at a position in the loop-shaped conductor that is closest to the radiation element.

18. The electronic apparatus according to claim 17, further comprising a capacitance element disposed on the radiation element.

19. The electronic apparatus according to claim 18, wherein the loop-shaped conductor comprises a gap disposed adjacent to the capacitance element disposed on the radiation element.

20. The electronic apparatus according to claim 17, wherein the loop-shaped conductor is disposed in a neck strap configured to be word around a user's neck, and the ground conductor and the radiation element are disposed in a housing.

* * * * *